US006079472A

United States Patent [19]

Schanz

[11] Patent Number: 6,079,472

[45] Date of Patent: Jun. 27, 2000

[54] ROLLER SHUTTER ARRANGEMENT MORE PARTICULARLY FOR OBLIQUELY ARRANGED ROLLER SHUTTER AREAS

[76] Inventor: Hans Schanz, Schulweg 5, D-72226 Simmersfeld, Germany

[21] Appl. No.: 09/126,774

[22] Filed: Jul. 31, 1998

[30] Foreign Application Priority Data

Aug. 27, 1997 [DE] Germany ..... 197 37 263

[51] Int. Cl.[7] ..... A47G 5/02

[52] U.S. Cl. ..... 160/265; 160/84.01; 160/84.06

[58] Field of Search ..... 160/84.01, 84.04, 160/84.06, 26, 68, 23.1, 120, 133, 238, 193, 290, 244, 310, 319, 322, 265

[56] References Cited

U.S. PATENT DOCUMENTS

| | | | |
|---|---|---|---|
| 490,448 | 1/1893 | Lugrin | 160/322 |
| 520,065 | 5/1894 | Lugrin | 160/322 |
| 3,460,602 | 8/1969 | Hugus | 160/265 |
| 5,159,967 | 11/1992 | Ashley | 160/265 |
| 5,299,617 | 4/1994 | Hying et al. | 160/265 X |
| 5,477,904 | 12/1995 | Yang | 160/84.06 X |
| 5,479,979 | 1/1996 | Hayashiguchi | 160/265 |
| 5,752,557 | 5/1998 | Crider et al. | 160/265 X |
| 5,873,401 | 2/1999 | Tsuchida | 160/84.01 X |

FOREIGN PATENT DOCUMENTS

| | | | |
|---|---|---|---|
| 2543610 | 10/1984 | France | 160/265 |

*Primary Examiner*—Daniel P. Stodola
*Assistant Examiner*—Bruce A. Lev
*Attorney, Agent, or Firm*—Browdy and Neimark

[57] ABSTRACT

A roller shutter arrangement, more especially for obliquely arranged roller shutter areas comprising a roller shutter element running in lateral guide rails and adapted to be wound and unwound on and from a take-up shaft arranged at one end of the roller shutter area. At least one elastic draw cable is provided engaging the free end part of the roller shutter element, and this draw cable is stretched on winding up the roller shutter element on the take-up shaft and on unwinding provides an elastic force aiding the unwinding operation. This means that automatic unwinding of the roller shutter element is possible in a simple and economic manner even if there is an insufficient or no action of gravity.

11 Claims, 2 Drawing Sheets

ROLLER SHUTTER ARRANGEMENT MORE PARTICULARLY FOR OBLIQUELY ARRANGED ROLLER SHUTTER AREAS

BACKGROUND OF THE INVENTION

The invention relates to a roller shutter arrangement more particularly for obliquely arranged roller shutter areas, comprising a roller shutter element running in lateral guide rails and adapted to be wound and unwound on and from a take-up shaft arranged at one end of the roller shutter area.

THE PRIOR ART

Such roller shutter arrangements have been proposed in wide variety of designs. For example in the case of vertical roller shutter arrangements, in which the take-up shaft is arranged above the roller shutter area, the weight force of the roller shutter element is generally sufficient to ensure automatic performance of the unwinding operation, that is to say the roller shutter element is wound up by manual or power rotation of the take-up shaft and on release it will be unwound automatically under its own weight.

The more oblique the roller shutter area, the less the action of gravity will be and the greater the effect of friction will be so that for example as from a certain slope automatic unwinding will no longer be possible. Although arrangements have already been proposed in which the unwinding operation is performed by draw cables, which are also driven by a drive motor, such drive arrangements call for a relatively complex and expensive free-wheel and other coupling means.

SHORT SUMMARY OF THE INVENTION

One object of the invention is to create a roller shutter arrangement, in the case of which the unwinding operation for the roller shutter element is ensured in a simple and economic manner without the action of gravity.

In order to achieve these and/or other objects appearing from the present specification, claims and drawings, in the present invention at least one elastic draw cable is provided engaging the free end part of the roller shutter element, such draw cable being stretched on winding up the roller shutter element on the take-up shaft and on unwinding provides an elastic force aiding the unwinding operation.

Consequently in the invention the force necessary for unwinding the roller shutter element is made available by the elastic force of the at least one draw cable, same being stretched on winding up, that is to say the winding up operation takes place against the force of this elastic draw cable. Since for this purpose merely one elastic draw cable or two elastic draw cables are necessary, an extremely economical design is possible requiring neither coupling means nor freewheel means and which ensure the unwinding of the roller shutter independently from the angular setting of the roller shutter area.

Further advantageous developments of the invention are defined in the claims.

In order to prevent the elastic draw cable presenting an ugly appearance or interfering with handle the roller shutter while at the same time ensuring that a constant unwinding force is made available, it is an advantage for two draw cables to be attached to the lateral terminal parts of the roller shutter element. Same are best arranged to run in the or on the guide rails so that they are not to be seen and are concealed.

The end of the at least one draw cable not attached to the roller shutter element only needs to stationarily secured to the roller shutter arrangement or a building provided with same.

In order to obtain the necessary length, which is able to be extended, of the at least one draw cable same is trained about at least one bend pulley for 180°. By having several such 180° bends it is thus possible to obtain the desired length of the draw cable. The at least one bend pulley is arranged on or in the guide rails so that it is concealed from view. In order to produce the effect of two draw cable while only actually having one, same may be trained in parallelism to the free end edge of the roller shutter element in or on the terminal slat thereof and extends from the two end parts of such slat in the unwinding direction. By displacement of such draw cable it is possible for the action of force on the two ends of the roller shutter element to be accurately set, automatic equalization of forces being possible as well by using bend pulleys on the terminal slat.

Further advantageous developments and convenient forms of the invention will be understood from the following detailed descriptive disclosure of two embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
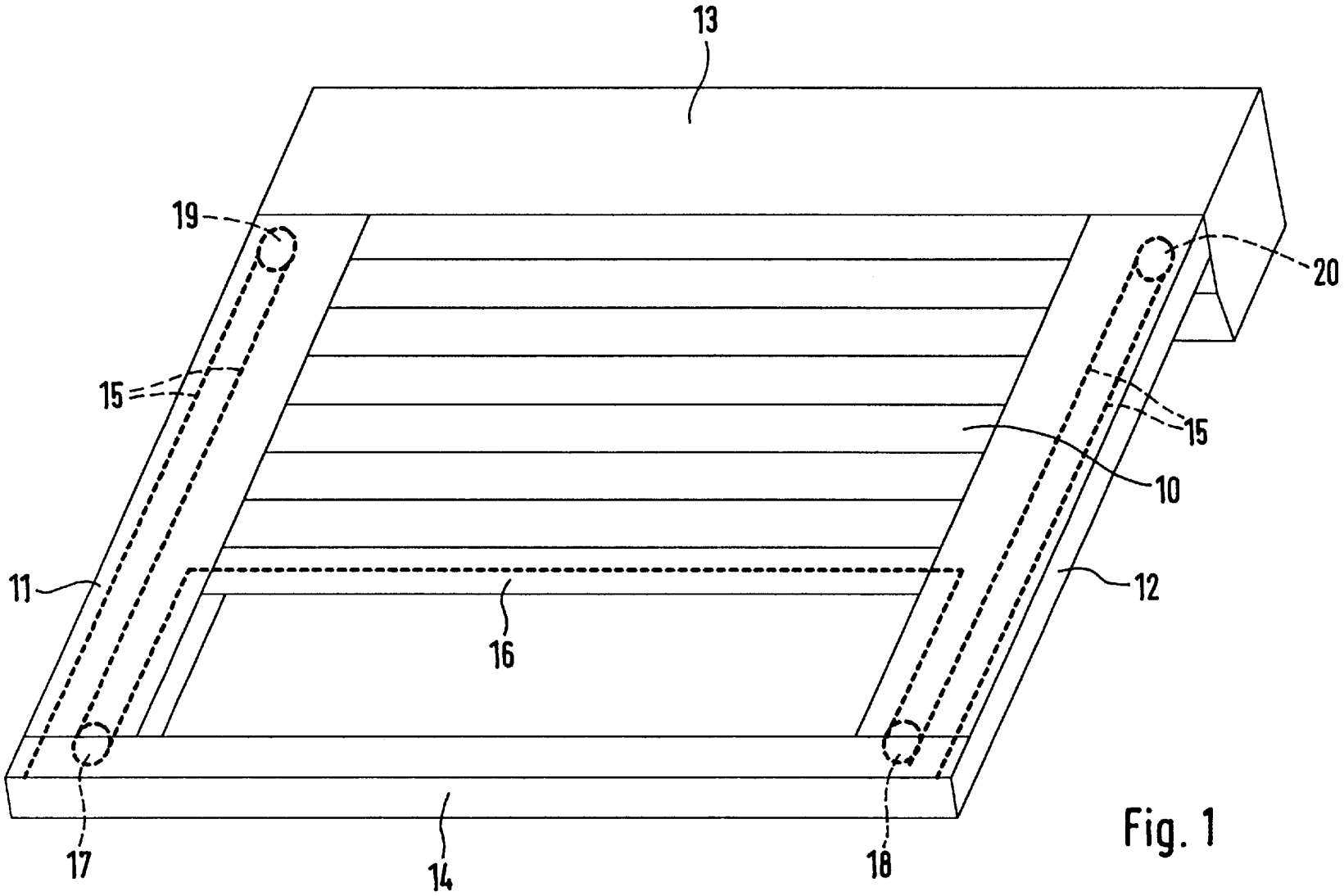
FIG. 1 shows a perspective elevation of a roller shutter arrangement with an obliquely arranged roller shutter area, the guide means for the elastic draw cable being indicated diagrammatically.
Figure 2:
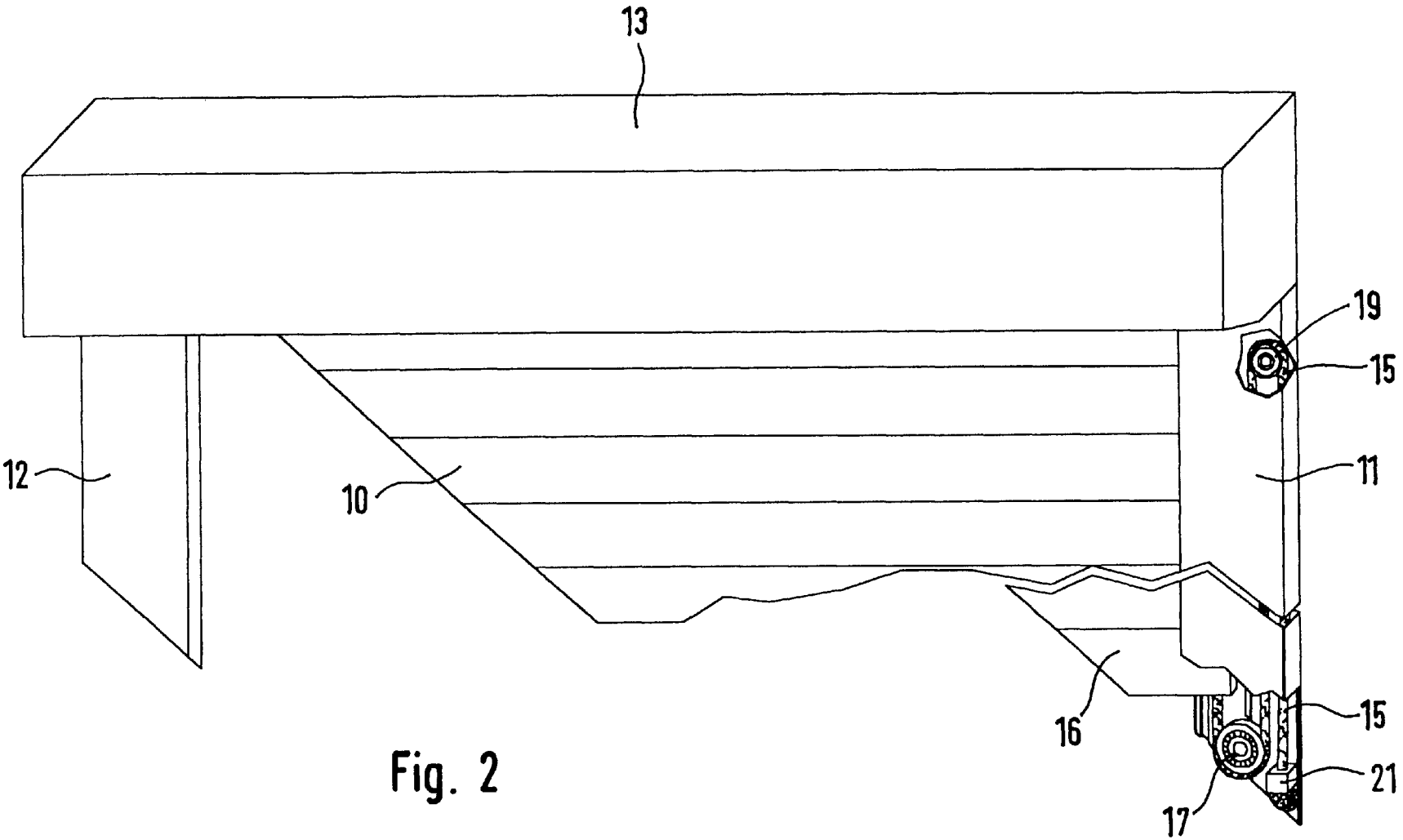
FIG. 2 shows part of a similar roller shutter arrangement with an oblique end edge of the roller shutter element from the opposite side, the guide rails being illustrated partially cut away in order to show the elastic draw cable and the bend pulley.

In the case of the embodiment of the invention illustrated in FIGS. 1 and 2 a roller shutter element 10 composed of individual slats runs on two lateral guide rails 11 and 12, of which one end respectively opens into a roller shutter chest 13, in which in a known manner, not described in detail, a take-up shaft is mounted in a rotatable manner for winding up the roller shutter element 10. This take-up shaft may also be provided with an electric drive motor for winding up the roller shutter element 10. As an alternative to this it is also possible for roller shutter webbing to be provided for winding up and unwinding the roller shutter element manually. The opposite end parts of the guide rails 11 and 12 are connected with each other by a connecting rail 14, which represents the terminal abutment for the roller shutter element 10 in the unwound state.

An elastic draw cable 15 runs through the terminal slat 16 at the free end part of the roller shutter element 10. The elastic draw cable 15 extends from the lateral end parts of this terminal slat 16 in the unwind direction and it is trained through an angle of 180° at the end part, remote from the roller shutter chest 13, of the connecting rail 14 by bend pulleys 17 and 18. From same the elastic draw cable 15 runs in the guide rails 11 and 12 respectively to the roller shutter chest 13, just short of which it is again trained through 180° by two bend pulleys 19 and 20 and thence runs back through the guide rails 11 and 12 to the terminal parts thereof remote from the roller shutter chest 13. Here the two ends of the draw cable 15 are secured by means of securing means 21 on the guide rails.

Owing to such training in bends the required stretchable length of the draw cable 15 is made available, the number of 180° bends being able to be adapted to requirements.

In the embodiments of the invention depicted the bend pulleys 17 through 20 and the draw cable 15 are arranged and run within the guide rails 11 and 12 so that them are concealed from sight. For this purpose the guide rails 11 and 12 for example possess separate chambers and/or channels for the draw cable 15 and the bend pulleys 17 through 20. It is naturally also possible to arrange the bend pulleys 17 through 20 without the guide rails 11 and 12 and also to arrange for the draw cable 15 to run outside the guide rails 11 and 12.

For equalization of forces or, respectively, for automatic setting of equal forces at the two) terminal parts of the terminal slat 16 it is possible for the elastic draw cable 16 on this terminal slat 16 as well to be trained over two further bend pulleys, not illustrated. On the other hand the equalization of forces aimed at may be produced by shifting the elastic draw cable 15 in the illustrated design as well.

In accordance with a further possible design it is possible for two draw cables to be provided, which are attached to the two terminal parts of the terminal slat 16. In the case of such a construction it is possible for an adjustment in length of the at least one of the draw cables may turn out to be convenient in order to arrive at setting in which the forces are equal.

In the case of an extremely simple element it is possible to provide only one draw cable, which for example may also be secured to the middle of the terminal slat 16 if such a draw cable in the middle here is not considered unattractive. In the case of the roller shutter element depicted in FIG. 2 the terminal slat 16 is extremely short and in this case a single lateral draw cable 15 will be found to be sufficient.

A significant feature of all embodiments is the principle of the function of the roller shutter arrangement of the invention that namely on winding up the roller shutter element 10 into the roller shutter chest 13 a draw cable is stretched to an increasing degree so that on unwinding the elastic force of this draw cable or these draw cables acts in the unwinding direction and ensures unwinding independent of gravitational forces.

What is claimed is:

1. A roller shutter arrangement for obliquely arranged roller shutter areas of a building, comprising a roller shutter element running in lateral guide rails and adapted to be wound and unwound on and from a take-up shaft arranged at one end of the roller shutter area, wherein at least one elastic draw cable is provided engaging a free end part of the roller shutter element, the draw cable being stretched upon winding up of the roller shutter element on the take-up shaft and on unwinding providing an elastic force aiding the unwinding operation, and wherein the draw cable is wrapped approximately 180° about more than one pulley.

2. The roller shutter arrangement as set forth in claim 1, wherein the draw cable is attached to two lateral terminal parts of the roller shutter element.

3. The roller shutter arrangement as set forth in claim 1, wherein the at least one draw cable is adapted to run along the guide rails.

4. The roller shutter arrangement as set forth in claim 1, wherein the end, opposite the end attached to the roller shutter element, of the at least draw cable is stationarily secured to the roller shutter arrangement.

5. The roller shutter arrangement as set forth in claim 1, wherein the pulley is arranged adjacent the guide rails.

6. The roller shutter arrangement as set forth in claim 1, wherein the draw cable extends in a direction parallel to a free end edge of the roller shutter element adjacent a terminal slat thereof and extends from the two end parts of the slat in the unwinding direction.

7. The roller shutter arrangement as set forth in claim 6, comprising two pulleys arranged on the terminal slat for the draw cable.

8. The roller shutter arrangement as set forth in claim 1, wherein one draw cable is attached to one lateral terminal part of the roller shutter element.

9. The roller shutter arrangement as set forth in claim 1, wherein the end, opposite the end attached to the roller shutter element, of the draw cable is adapted to be stationarily secured to the building provided with the roller shutter arrangement.

10. The roller shutter arrangement as set forth in claim 1, wherein the draw cable comprises two draw cable portions attached respectively to two lateral terminal parts of the roller shutter element.

11. A roller shutter mechanism comprising a roller shutter element adapted to cover an area, the mechanism exerting a substantially constant force on the roller shutter element, wherein the roller shutter element runs in lateral guide rails and is windable and un-windable onto and off of a take-up shaft disposed at one end of the area coverable by the roller shutter element; the mechanism comprising:

at least one elastic draw cable having a first end thereof engaging a free end of the roller shutter element and a second end thereof stationarily fixed;

wherein the elastic draw cable is wrapped approximately 180° about more than one pulley, whereby an effective length of the elastic draw cord is increased to provide a substantially constant force.

* * * * *